US006247385B1

(12) United States Patent
Wu

(10) Patent No.: US 6,247,385 B1
(45) Date of Patent: Jun. 19, 2001

(54) ROTATABLE TOOL HANDLE HAVING A RECOVERY DEVICE

(76) Inventor: Arthur Wu, P.O. Box 63-99, Taichung (TW), 406

( * ) Notice: Subject to any disclaimer, the term of this patent is extended or adjusted under 35 U.S.C. 154(b) by 0 days.

(21) Appl. No.: 09/522,031

(22) Filed: Mar. 9, 2000

(51) Int. Cl.[7] ..... B25B 23/16

(52) U.S. Cl. ..... 81/177.1; 81/177.2; 81/177.5; 81/489

(58) Field of Search ..... 81/177.1, 177.2, 81/177.5, 177.8, 489

(56) References Cited

U.S. PATENT DOCUMENTS 3,132,548 * 5/1964 Livermont .
3,701,295 * 10/1972 Mende .
5,852,960 12/1998 Wu ..... 81/177.5
6,092,442 * 7/2000 Macor .

* cited by examiner

*Primary Examiner*—Timothy V. Eley
*Assistant Examiner*—Willie Berry, Jr.

(57) ABSTRACT

A tool includes a handgrip having a chamber for rotatably receiving a handle and having one or more stop surfaces for engaging with the handle and for limiting the rotational movement of the handle relative to the handgrip. One or more blocks are secured to the handle and rotatably received in the handgrip. A fastener is secured in the handgrip and engaged through an oblong hole of the handle. One or more springs may recover the handle relative to the handgrip. A knob may selectively lock the handle to the handgrip.

13 Claims, 9 Drawing Sheets

ROTATABLE TOOL HANDLE HAVING A RECOVERY DEVICE

BACKGROUND OF THE INVENTION

1. Field of the Invention

The present invention relates to a tool, and more particularly to a rotatable tool handle having an auto-return or a recovery device.

2. Description of the Prior Art

U.S. Pat. No. 5,852,960 to Wu discloses a typical wrench having a rotatable handgrip rotatably secured onto a handle of the wrench. The handgrip may rotate freely relative to and around the handle and may not be limited to a relative rotational movement relative to the handle.

The present invention has arisen to mitigate and/or obviate the afore-described disadvantages of the conventional tool handles.

SUMMARY OF THE INVENTION

The primary objective of the present invention is to provide a tool including a handgrip rotatably secured onto a handle of the tool and having a limited rotational movement relative to the handle.

In accordance with one aspect of the invention, there is provided a tool comprising a handgrip including a chamber formed therein, a handle rotatably received in the chamber of the handgrip, and means for limiting a rotational movement of the handle relative to the handgrip.

The chamber of the handgrip is greater in size than that of the handle for allowing the handle to be rotated relative to the handgrip. The limiting means includes at least one stop surface formed in the handgrip for engaging with the handle and for limiting the rotational movement of the handle relative to the handgrip.

At least one block is secured onto the handle and rotatably received in the chamber of the handgrip. The handgrip includes a cavity formed therein and communicating with the chamber of the handgrip, the block includes a protrusion extended therefrom and rotatably engaged in the cavity of the handgrip for rotatably securing the block in the handgrip. The handle includes an oblong hole formed therein, the limiting means includes a fastener secured in the handgrip and engaged through the oblong hole of the handle.

At least one spring is engaged between the handle and the handgrip for applying a spring-biasing force onto the handle against the handgrip. The handle and the handgrip each includes at least one hole formed therein for receiving the spring. A cover is further secured onto the handgrip for blocking the hole of the handgrip.

A device is further provided for selectively locking the handle to the handgrip and includes a cap secured onto the handle and having at least one channel formed therein, and a knob slidably received in the channel of the cap and selectively engaged with the handgrip for selectively locking the handle to the handgrip.

The handgrip includes a pin secured thereto and partially extended inward of the channel of the cap, the knob includes a leg selectively engaged with the pin. The leg of the knob includes a hole formed therein for selectively receiving the pin and for selectively locking the handle to the handgrip. The cap includes a recess formed therein for slidably receiving the knob.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
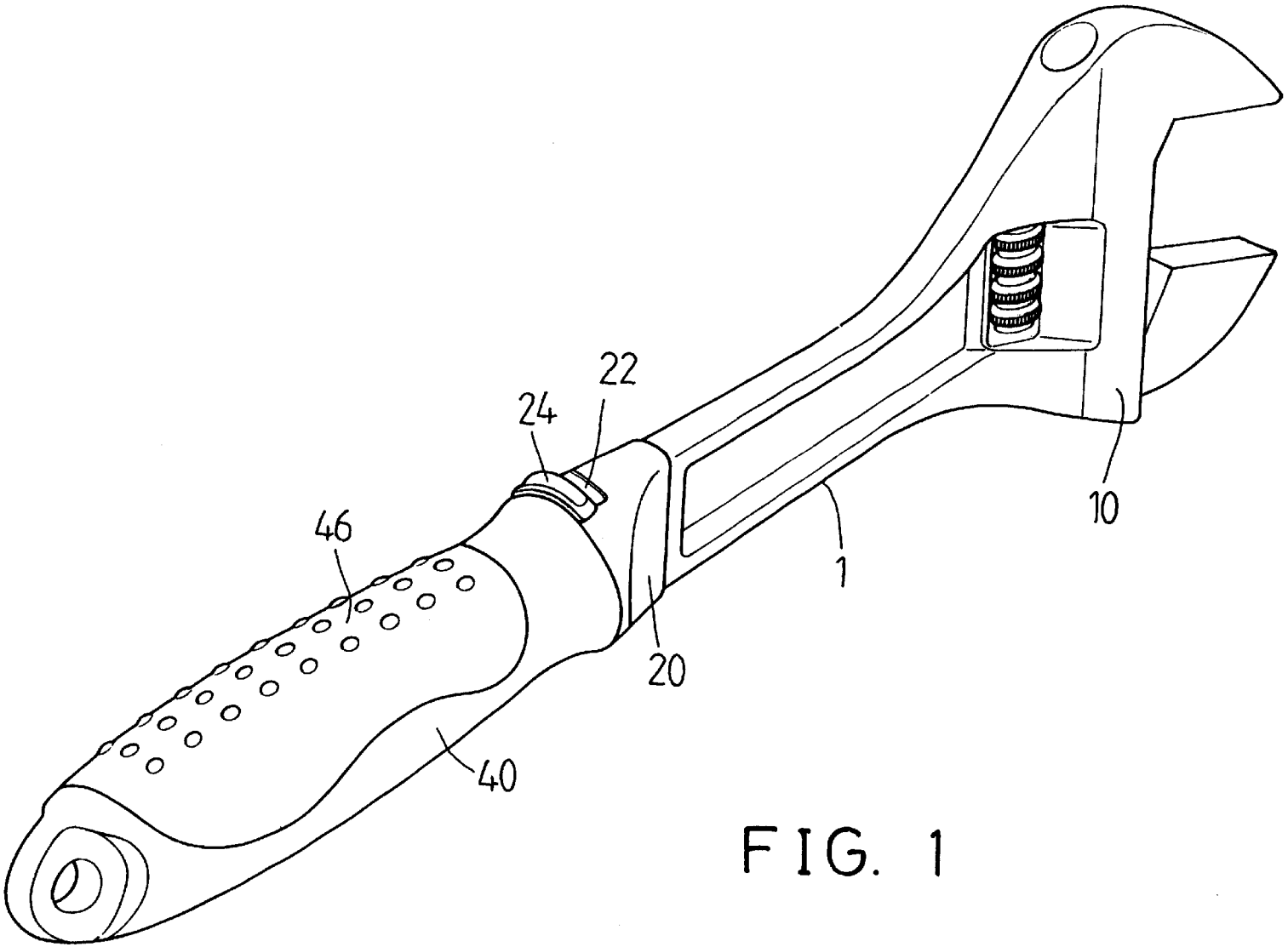
FIG. 1 is a perspective view of a tool in accordance with the present invention.
Figure 2:
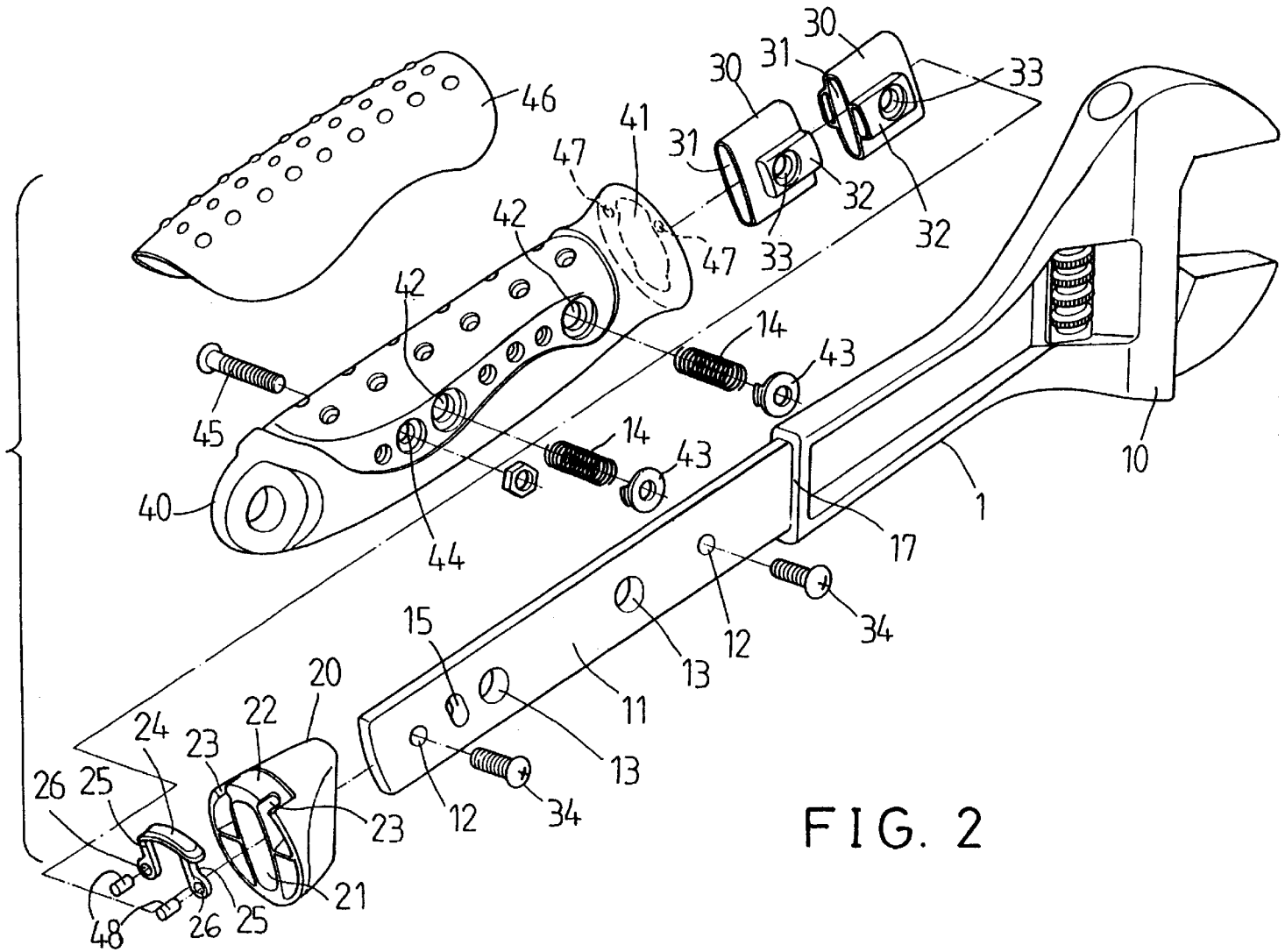
FIG. 2 is an exploded view of the tool.
Figure 3:
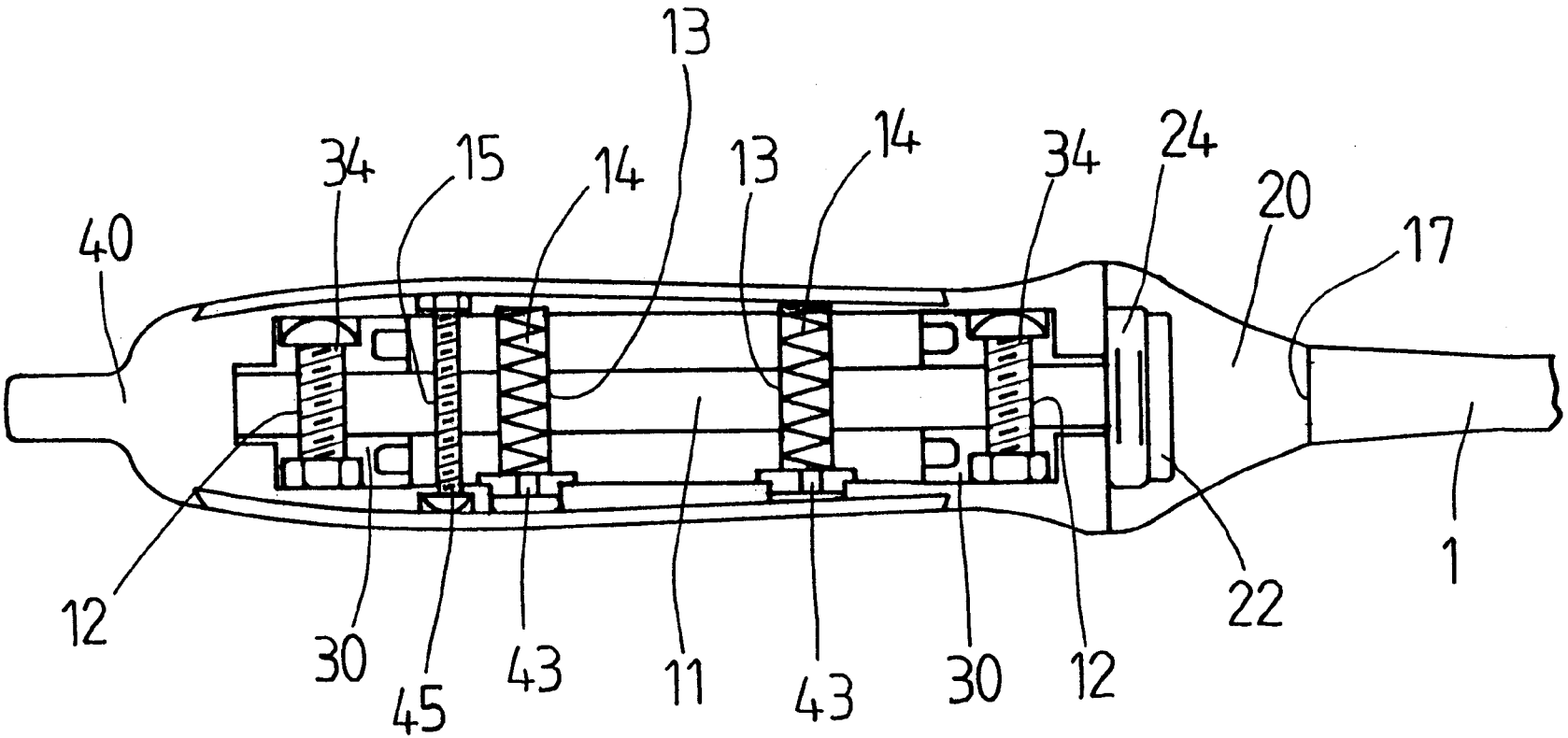
FIG. 3 is a schematic view illustrating the relative position between the elements.

Referring to the drawings, and initially to FIGS. 1–3, a tool in accordance with the present invention comprises a body 1 including a tool member 10, such as a wrench, particularly an adjustable wrench 10, provided on one end thereof, and including a handle 11 extended on or from the other end thereof, opposite to the tool member 10. As best shown in FIG. 2, it is preferable that the handle 11 is smaller in size than that of the body 1 for defining a peripheral shoulder 17 between the handle 11 and the body 1. The handle 11 includes a substantially rectangular cross section, or an oval cross section or a non-circular cross section.

A cap 20 includes an orifice 21 formed therein for receiving the handle 11 and having a cross section corresponding to that of the handle 11 for allowing the cap 20 to be secured onto the handle 11 and to be rotated in concert with the handle 11. The cap 20 is preferably engaged with the peripheral shoulder 17 of the body 1 and includes a recess 22 formed in the upper portion thereof and includes one or more channels 23 formed therein and preferably parallel to each other and communicating with the recess 22 of the cap 20. A knob 24 is slidably received in the recess 22 of the cap 20 and includes one or more legs 25 extended therefrom and slidably engaged in the respective channels 23 of the cap 20. The legs 25 each has a hole 26 formed therein for slidably receiving or for securing a respective pin 48.

One or more blocks 30 each includes an aperture 31 formed therein for receiving the handle 11 and having a cross section corresponding to that of the handle 11 for allowing the blocks 30 to be secured onto the handle 11 and to be rotated in concert with the handle 11. One or more fasteners 34 are engaged through the holes 33 of the blocks 30 and the holes 12 of the handle 11 for securing the blocks 30 onto the handle 11. The blocks 30 each includes one or more protrusions 32 extended therefrom and each having a curved outer peripheral surface 37 formed thereon, best shown in FIGS. 4–7.

A handgrip 40 includes a chamber 41 formed therein for receiving the blocks 30 and the handle 11 and having a size greater than that of the blocks 30 for allowing the blocks 30 and the handle 11 to be rotated relative to the handgrip 40. The handgrip 40 includes one or more stop surfaces 80 (FIGS. 4–7) formed therein for engaging with the blocks 30 and/or the handle 11 and for limiting the rotational movement of the handle 11 relative to the handgrip 40 or the rotational movement of the handgrip 40 relative to the handle 11. The handgrip 40 includes a curved or a circular cavity 49 formed therein and communicating with the chamber 41 of the handgrip 40 for rotatably receiving the protrusion(s) 32 of the blocks 30 and for rotatably securing the handle 11 and the blocks 30 within the handgrip 40. The engagement of the stop surfaces 80 of the handgrip 40 with the blocks 30 and/or the handle 11 limits the handle 11 to rotate relative to the handgrip 40, and vice versa. A fastener 45 is engaged through a hole 44 of the handgrip 40 and engaged through an oblong hole 15 of the handle 11 for securing the handgrip 40 onto the handle 11 and for allowing the handle 11 to be rotated relative to the handgrip 40 for a limited angular movement.

One or more springs 14 are engaged through the holes 42 (FIGS. 6, 7) of the handgrip 40 and engaged through the holes 13 of the handle 11 and preferably have the ends secured to the handgrip 40 for applying a spring-biasing force against the handle 11 and for recovering the handle 11 to the middle or central position of the handgrip 40 (FIGS. 4–7). One or more lids 43 may be secured to the handgrip 40 and may block the holes 42 of the handgrip 40 for solidly securing the springs 14 within the handgrip 40. One ends of the springs 14 may be secured to the lids 43 instead of being secured to the handgrip 40. A shield or a cover 46 may be secured onto the handgrip 40 for blocking the holes 42, 44 of the handgrip 40. The handgrip 40 includes a front portion having one or more holes 47 formed therein for receiving the pins 48. The pins 48 may be moved inward and outward of the holes 47 by the knob 24 to lock and to release the handgrip 40.

Figure 8:
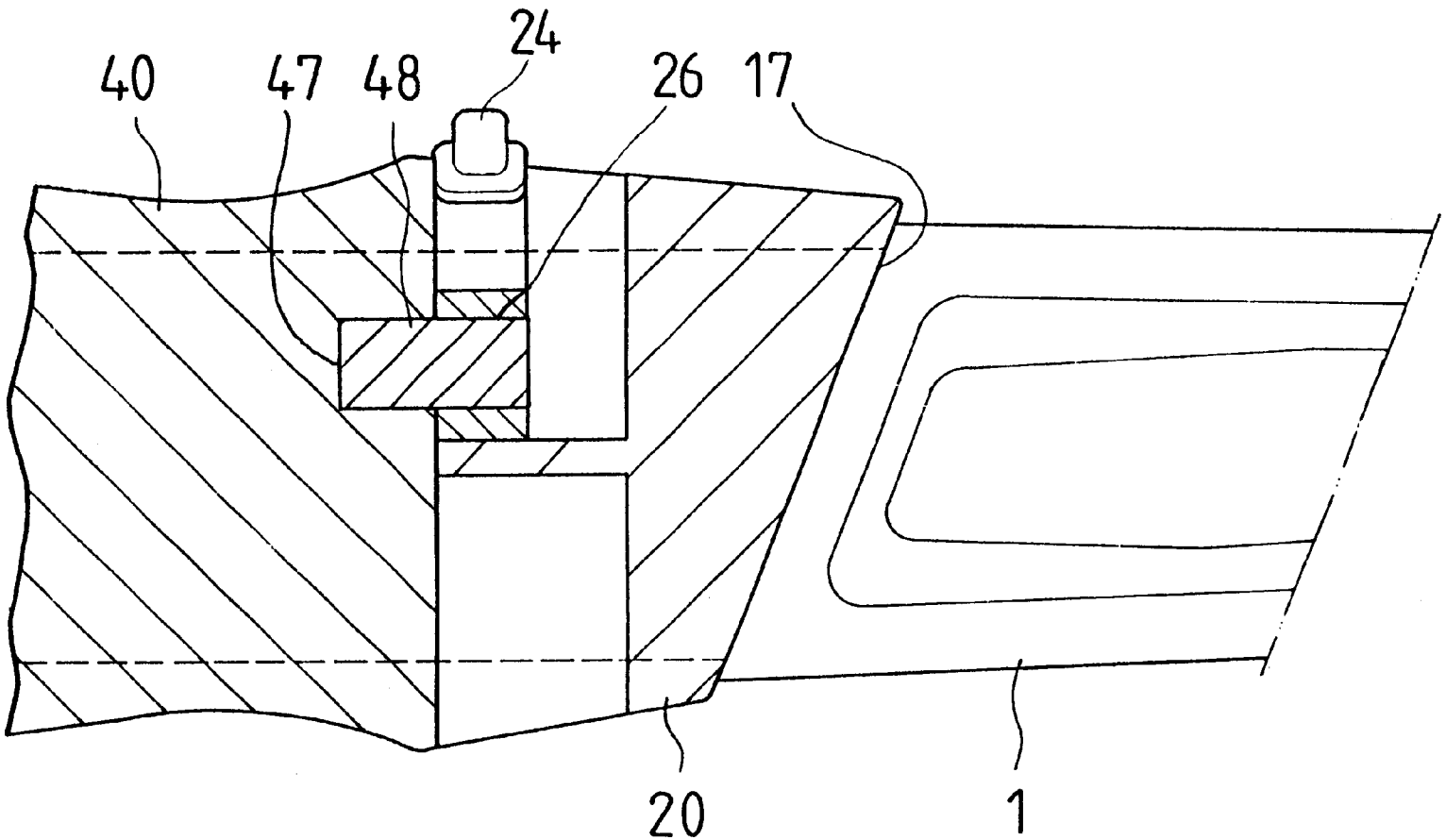
FIGS. 8 and 9 are schematic views illustrating the release and the lock of the handgrip to the handle.
Figure 9:
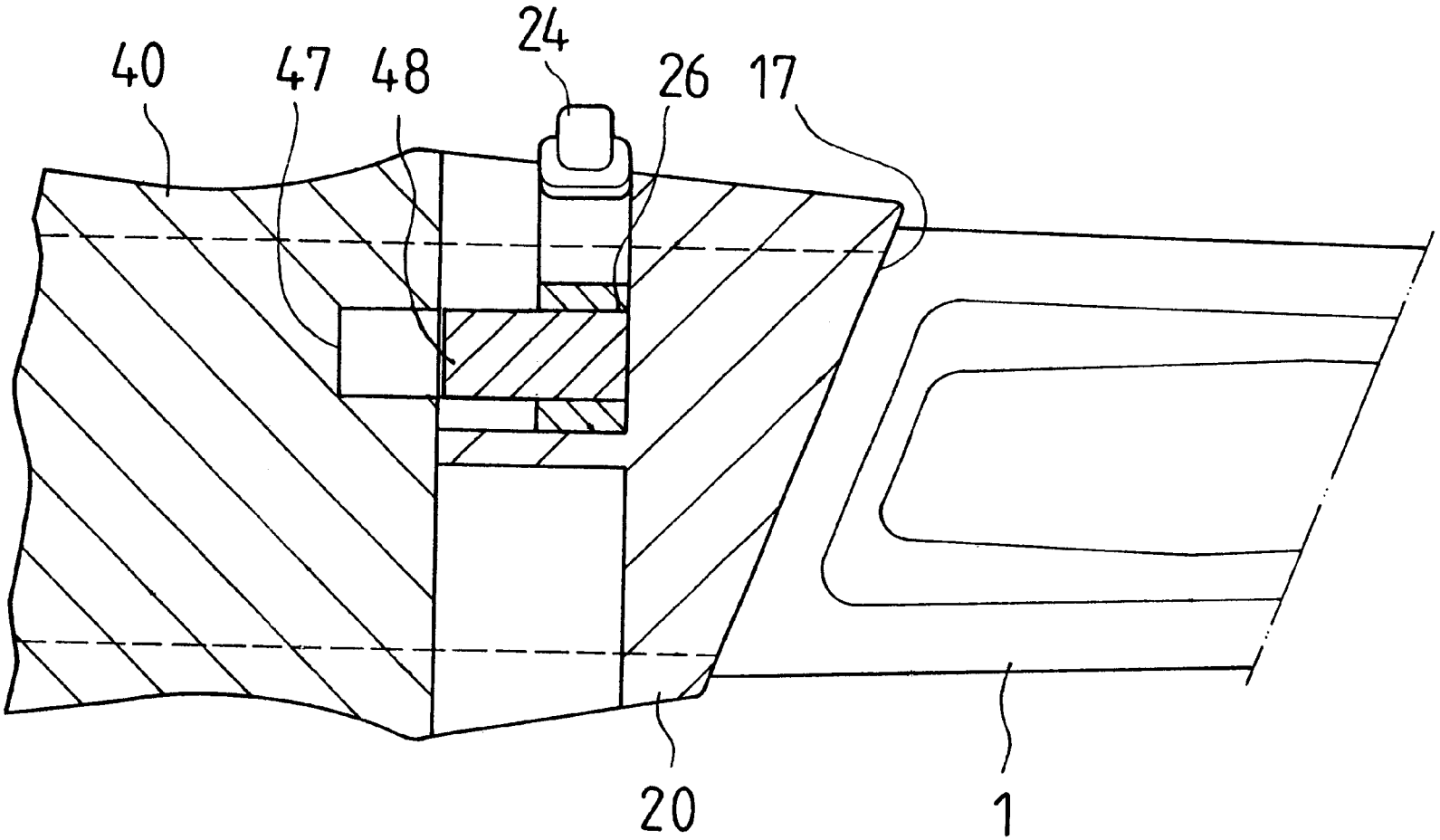

Referring next to FIG. 8, the pins 48 are engaged into the holes 47 of the handgrip 40 such that the handgrip 40 may be secured to the handle 11 of the body 1 by the engagement of the pins 48 in the handgrip 40. As shown in FIG. 9, when the knob 24 is pushed forward toward the body 1 or toward the tool member 10, the pins 48 may be disengaged from the handgrip 40 such that the handgrip 40 is not locked to the cap 20 and the body 1 and such that the handgrip 40 may be rotated relative to the handle 11 for the limited rotational movement. Alternatively, the pins may be secured to the handgrip 40 and selectively engaged into the holes 26 of the legs 25 of the knob 24.

Figure 4:
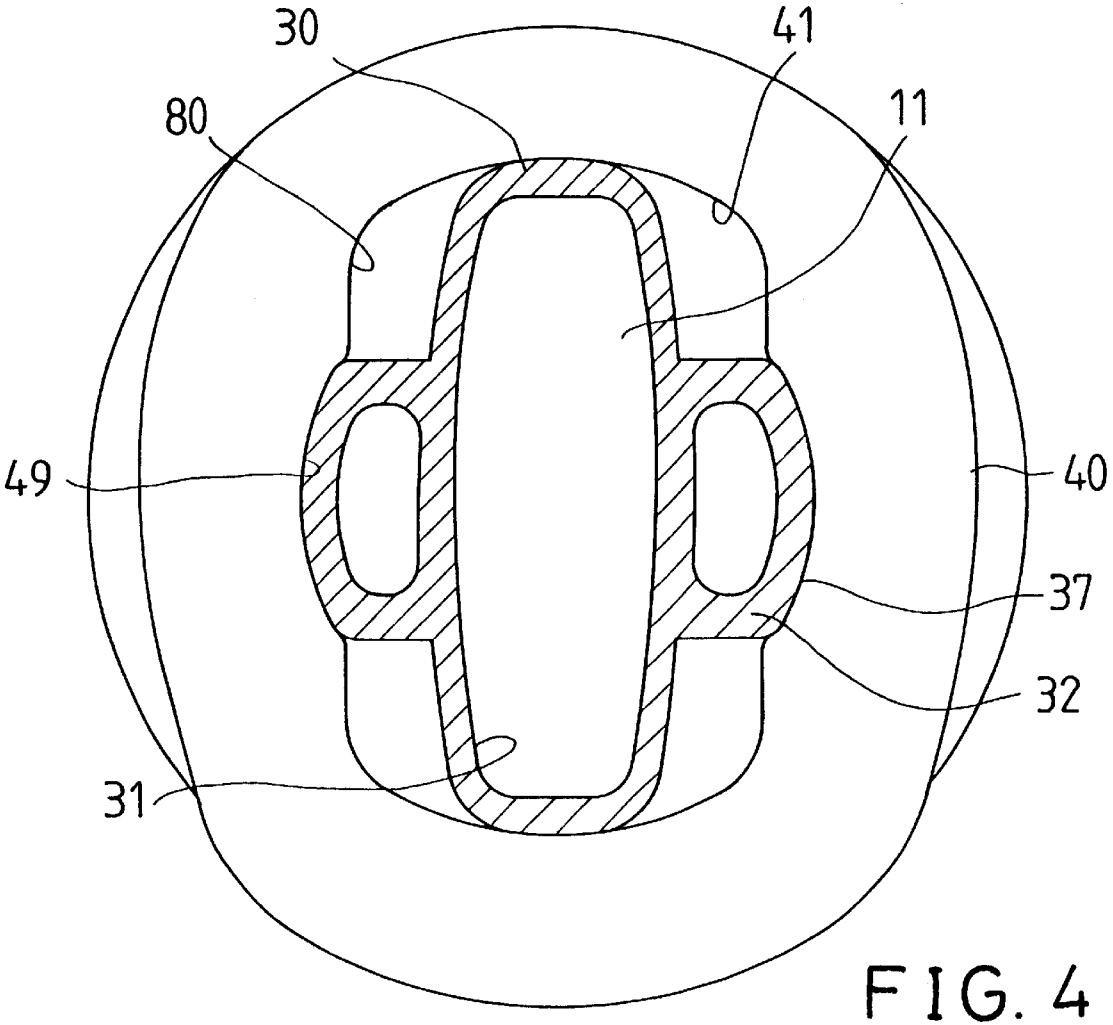
FIGS. 4 and 5 are schematic views illustrating the rotational movement of the handgrip relative to the handle.
Figure 5:
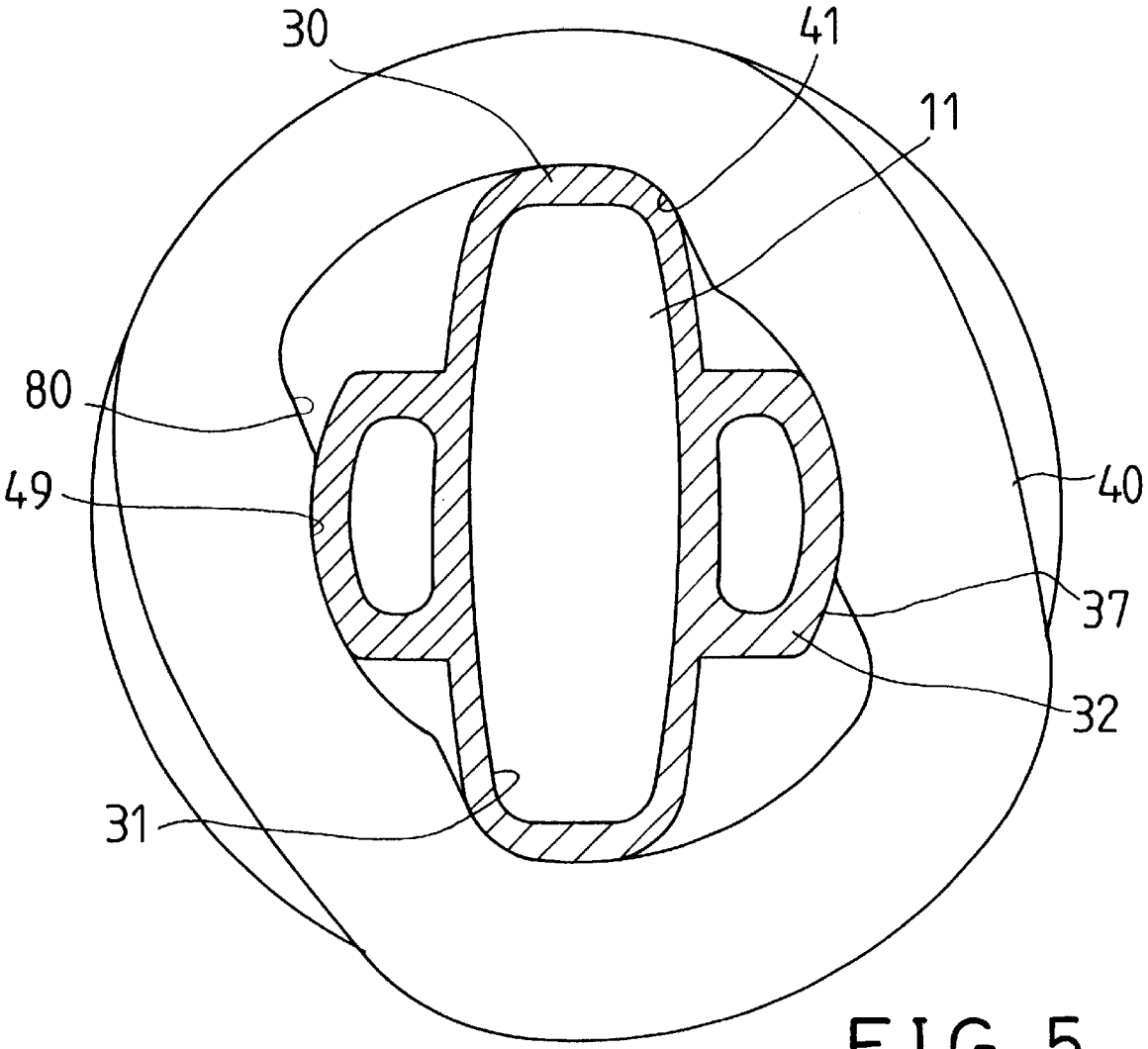
Figure 6:
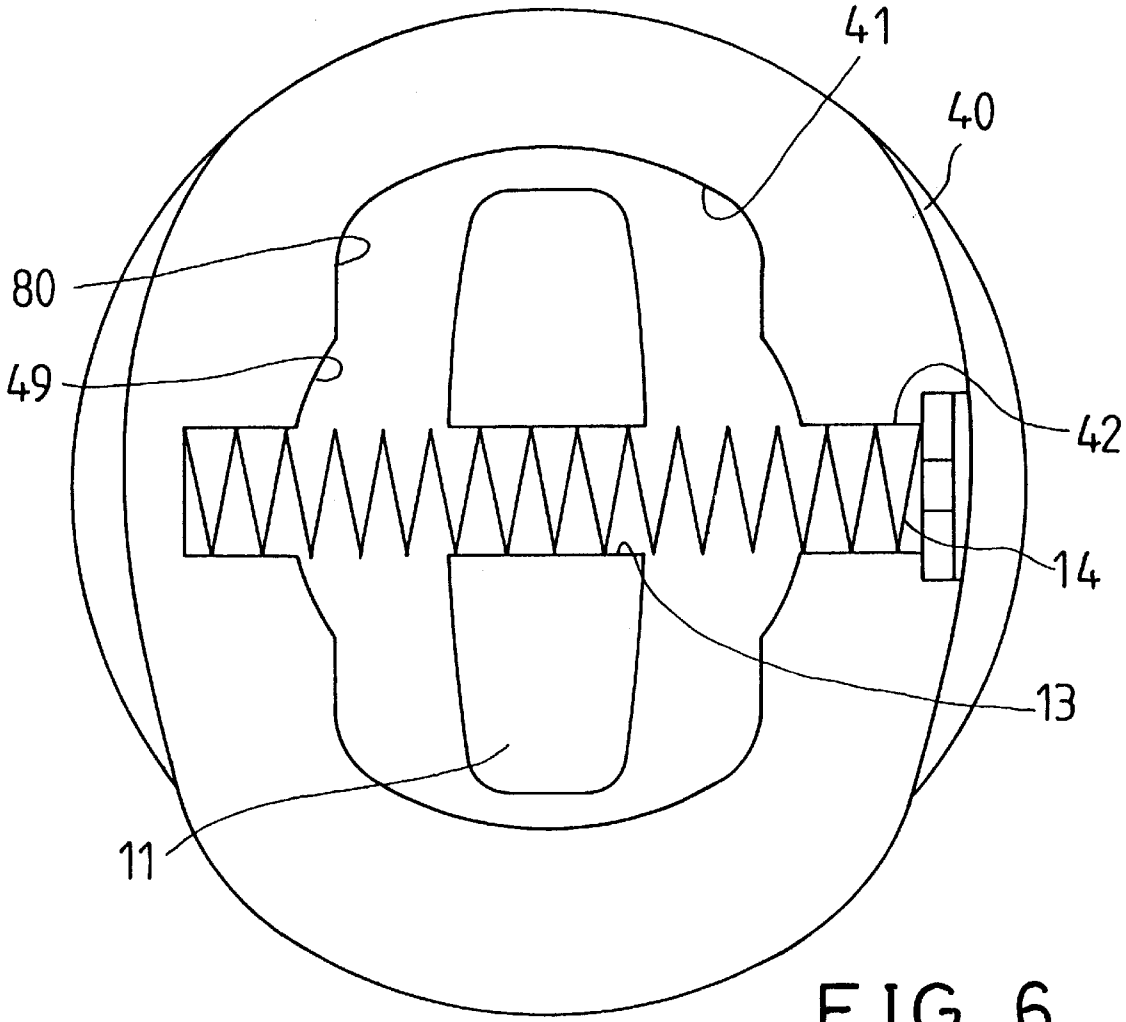
FIGS. 6 and 7 are schematic views illustrating the action of the springs to the rotational movement of the handgrip relative to the handle.
Figure 7:
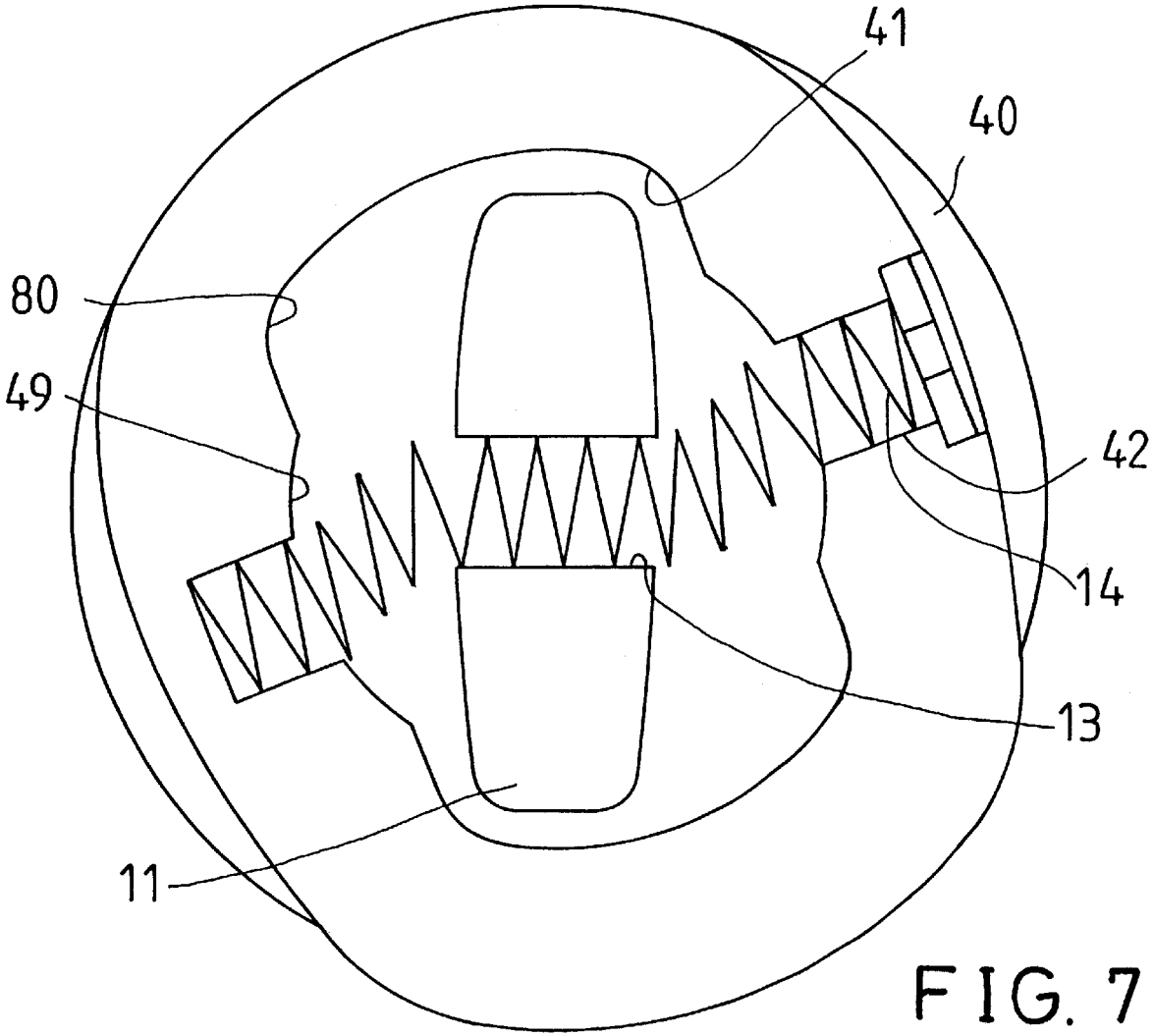

In operation, as shown in FIG. 8, when the knob 24 is moved rearward to engage the pins 48 into the holes 47 of the handgrip 40, the handgrip 40 is locked to the body 1 via the cap 20, such that the handgrip 40 may not be rotated relative to the handle 11 of the body 1. As shown in FIG. 9, when the knob 24 is pushed away from the handgrip 40 to disengage the pins 48 from the handgrip 40, the handgrip 40 is not locked to the cap 20 and is allowed to rotate relative to the handle 11 for the limited relative rotational movement (FIGS. 4, 5). The springs 14 may recover the handle 11 to the middle or central position of the handgrip 40 (FIGS. 6, 7) when the handgrip 40 is rotated relative to the handle 11. When the tool is used for driving a fastener by grasping the handgrip 40 and by rotating the handgrip 40 about the fastener, the handgrip 40 may rotate relative to the handle 11 and/or may be recovered relative to the handle 11 such that the tool may easily operated. The operation of the tool to a fastener or the like has been disclosed in U.S. Pat. No. 5,852,960 to Wu which is taken as a reference for the present invention.

Accordingly, the tool in accordance with the present invention includes a handgrip rotatably secured onto a handle of the tool and having a limited rotational movement relative to the handle.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A tool comprising:

a handgrip including a chamber formed therein, a handle rotatably received in said chamber of said handgrip, and means for limiting a rotational movement of said handle relative to said handgrip, said limiting means including at least one stop surface formed in said handgrip for engaging with said handle and for limiting the rotational movement of said handle relative to said handgrip.

2. The tool according to claim 1, wherein said chamber of said handgrip has a size greater than that of said handle for allowing said handle to be rotated relative to said handgrip.

3. The tool according to claim 1 further comprising at least one block secured onto said handle and rotatably received in said chamber of said handgrip.

4. The tool according to claim 1 further comprising means for selectively locking said handle to said handgrip.

5. A tool comprising:

a handgrip including a chamber formed therein, said handgrip including a cavity formed therein and communicating with said chamber of said handgrip, a handle rotatable received in said chamber of said handgrip, means for limiting a rotational movement of said handle relative to said handgrip, and at least one block secured onto said handle and rotatable received in said chamber of said handgrip, said at least one block including a protrusion extended therefrom and rotatably engaged in said cavity of said handgrip for rotatably securing said at least one block in said handgrip.

6. A tool comprising:

a handgrip including a chamber formed therein, a handle rotatable received in said chamber of said handgrip, said handle including an oblong hole formed therein, and means for limiting a rotational movement of said handle relative to said handgrip, said limiting means including a fastener secured in said handgrip and engaged through said oblong hole of said handle.

7. A tool comprising:

a handgrip including a chamber formed therein, a handle rotatably received in said chamber of said handgrip, means for limiting a rotational movement of said handle relative to said handgrip, and at least one spring engaged between said handle and said handgrip for applying a spring-biasing force onto said handle against said handgrip.

8. The tool according to claim 7, wherein said handle and said handgrip each includes at least one hole formed therein for receiving said at least one spring.

9. The tool according to claim 8 further comprising a cover secured onto said handgrip for blocking said at least one hole of said handgrip.

10. A tool comprising:

a handgrip including a chamber formed therein, a handle rotatable received in said chamber of said handgrip, means for limiting a rotational movement of said handle relative to said handgrip, and means for selectively locking said handle to said handgrip, said selectively locking means including a cap secured onto said handle and having at least one channel formed therein, and a knob slidably received in said at least one channel of said cap and selectively engaged with said handgrip for selectively locking said handle to said handgrip.

11. The tool according to claim 10, wherein said knob includes at least one leg extended therefrom, and at least one pin secured to said at least one leg for engaging into said handgrip and for locking said handgrip to said cap.

12. The tool according to claim 11, wherein said handgrip includes a hole formed therein for selectively receiving said at least one pin and for selectively locking said handle to said handgrip.

13. The tool according to claim 10, wherein said cap includes a recess formed therein for slidably receiving said knob.

* * * * *